US007108447B2

(12) United States Patent
Akkala et al.

(10) Patent No.: US 7,108,447 B2
(45) Date of Patent: Sep. 19, 2006

(54) CONSTRUCTION CASTINGS WITH BALL AND SOCKET CONNECTORS

(75) Inventors: Steven M. Akkala, Neenah, WI (US); Timothy J. Law, Neenah, WI (US)

(73) Assignee: Neenah Foundry Company, Neenah, WI (US)

( * ) Notice: Subject to any disclaimer, the term of this patent is extended or adjusted under 35 U.S.C. 154(b) by 0 days.

(21) Appl. No.: 10/837,958

(22) Filed: May 3, 2004

(65) Prior Publication Data

US 2005/0244227 A1 Nov. 3, 2005

(51) Int. Cl.
*B65D 43/24* (2006.01)

(52) U.S. Cl. ..... 404/25; 220/810; 220/831; 16/224; 403/122

(58) Field of Classification Search ..... 404/25; 52/19; 137/364; 220/810, 831; 16/224; 403/122, 127

See application file for complete search history.

(56) References Cited

U.S. PATENT DOCUMENTS

| | | | | |
|---|---|---|---|---|
| 401,560 | A * | 4/1889 | Hotchkiss | 16/224 |
| 782,327 | A * | 2/1905 | Diehl | 16/224 |
| 797,185 | A * | 8/1905 | Diehl | 16/268 |
| 1,225,679 | A * | 5/1917 | Ransehousen | 220/210 |
| 4,109,821 | A * | 8/1978 | Lutz | 220/836 |
| 4,840,514 | A | 6/1989 | Defrance et al. | |
| 5,531,541 | A * | 7/1996 | Clover et al. | 404/25 |
| 5,745,953 | A * | 5/1998 | Golden | 16/260 |
| 6,113,301 | A * | 9/2000 | Burton | 403/122 |
| 6,302,612 | B1 * | 10/2001 | Fowler et al. | 403/76 |

FOREIGN PATENT DOCUMENTS

| | | |
|---|---|---|
| EP | 0420777 B1 | 7/1993 |
| EP | 1160382 A1 | 5/2001 |
| EP | 0796949 B1 | 6/2001 |
| EP | 0856611 B1 | 9/2001 |
| JP | 7018691 | 1/1995 |
| JP | 11131515 | 5/1999 |
| JP | 11323985 | 11/1999 |

OTHER PUBLICATIONS

Saint-Gobain, Pamrex Manhole Covers (Brochure).

* cited by examiner

*Primary Examiner*—Gary S. Hartmann
(74) *Attorney, Agent, or Firm*—Quarles & Brady LLP

(57) ABSTRACT

A joint suitable for construction castings having a frame and a lid or cover, such as manholes, grates, trench drains, hatches and the like, and construction castings incorporating the same. No tools are necessary to separate the joint. A ball head located on a lid fits into a socket located on a frame or adjacent lid. To separate the ball head from the socket, the lid is lifted to a substantially vertical position and turned about ninety degrees. The lid can then be lifted away from the socket. When the joint is used in manhole or hatch assemblies, a latch may be used to hold the cover open and the cover may be opened and closed with a lever.

2 Claims, 8 Drawing Sheets

CONSTRUCTION CASTINGS WITH BALL AND SOCKET CONNECTORS

BACKGROUND OF THE INVENTION

The present invention relates generally to construction castings, and more particularly to manhole, grate, catch basin, trench drain and hatch assemblies for covering openings and access points (hereinafter "covers").

Typically, manholes and other types of hatches must be covered either fully or partially (as with a grate) because they are needed in places where they are crossed over by pedestrians, cars, trucks, and even aircraft. Some of these manholes and hatches have hinged covers that can be conveniently opened and closed. Unlike non-hinged covers, hinged covers cannot become partially unseated as can happen with a sewer surcharge. Hinged covers may also be opened more easily than non-hinged covers.

One type of hinged cover is shown in Defrance et al., U.S. Pat. No. 4,840,514. Defrance discloses a manhole assembly having a lid that is hinged to a frame with a T-shaped lug. There are two principal disadvantages to this particular construction. First, in order to remove or replace the cover itself, something that is periodically necessary, an operator has to be able to lift the cover straight up to release it from the position in which it is held open. Given the weight and size of most such covers, this is a particularly difficult task. Second, these hinged covers cannot be lifted with ordinary levers thus requiring the application of brute force.

Another type of hinged cover is shown in a European Patent Office publication for Saint-Gobain PAM, EP 1160382. This hinged cover locks by dropping a lug down into a hinge receptor, requiring one to lift the cover before it can be lowered. This causes the user to lift the weight of the cover each time it is used, even when the cover is not removed from the frame.

Like manhole and hatch assemblies, trench drain grates and solid covers are used in places where they are crossed over by pedestrians, cars, trucks, and even aircraft, and are not easily accessed. Trench drain and grate covers fit into a frame that typically spans the width of a driveway or other area where drainage or ventilation is desirable. Frequently, it is necessary to fasten these grates and covers to the frames. In usual applications, each separate cover is bolted to the frame with a number of bolts—typically one in each corner or otherwise fastened with one of many types of an internal mechanical locking device. If one desires access to the trench or drain below the cover, each bolt must be removed or the mechanical locking device released so the cover can be lifted and removed. Lid removal is time consuming and sometimes difficult due to damaged bolts, broken mechanical locking devices or dirt. In addition, bolt patterns and mechanical lifting devices may change due to wear, and it may be difficult to replace the removed lids if they do not have the same orientation as they did prior to removal.

Accordingly, there is a well established need for a connector used in conjunction with various construction castings that is simple and easy to use and maintain. Because construction castings are typically heavy, there is a further need for construction castings that are more ergonomic for lid or cover opening and removal.

SUMMARY OF THE INVENTION

The present invention overcomes many of the drawbacks and disadvantages of the prior art. It includes a hinge construction that is simple and easy to manufacture. Moreover, covers made in accordance with the present invention can be lifted with a lever, thus greatly reducing the amount of lifting force required to open the cover. As a result of the hinge design of the present invention, covers can be readily removed from the hinge receptor, facilitating easy removal and replacement, without the use of tools.

In one embodiment, the joint is used in a round or rectangular manhole or hatch assembly. This joint may have certain features that limit the movement of a cover with respect to a frame. In another aspect of the invention, the joint is used to connect grates or trench-type drains in series. Generally, the grates are connected end-to-end and use relatively few bolts to lock the grates to a frame. In yet another aspect of the invention, the joint is used again to connect grates or trenches to a frame. Rather than linking each cover or grate together, each grate is instead independently connected to the frame. For example, a ball head extends from each grate that, in turn, fits into a corresponding socket on the frame.

Various other features, objects, and advantages of the invention will be made apparent to those skilled in the art from the following detailed description including illustrative examples setting forth how to make and use the invention.

DESCRIPTION OF PREFERRED EMBODIMENTS

Figure 1:
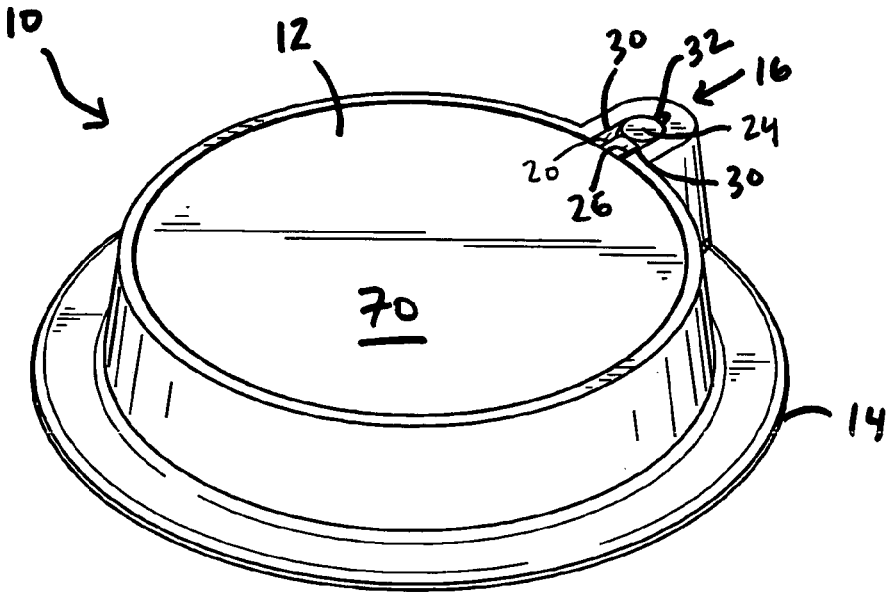
FIG. 1 is a perspective view of a manhole frame and cover connected with a ball and socket joint of the present invention.
Figure 1A:
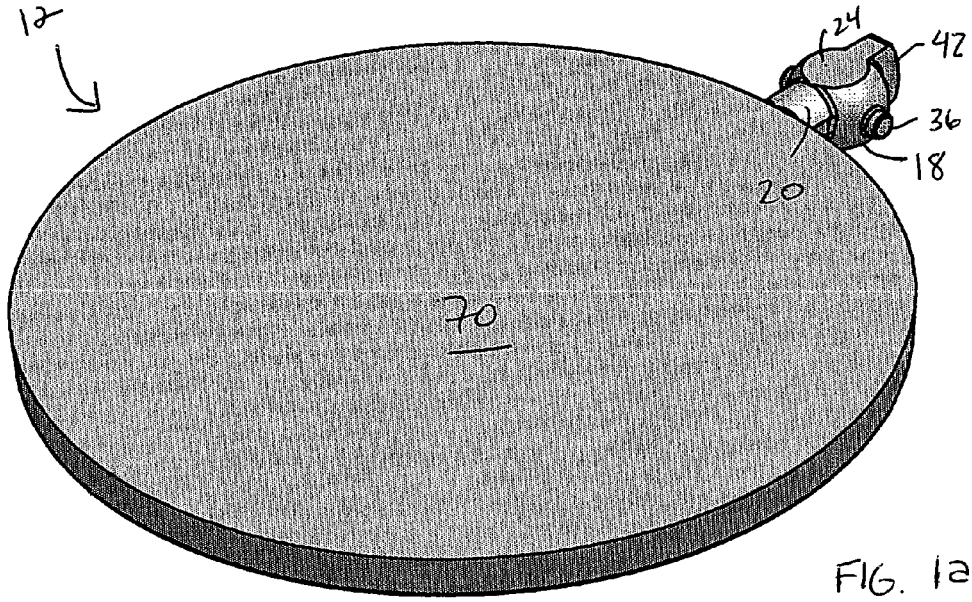
FIG. 1*a* is a perspective view of the manhole cover of FIG. 1, the cover shown separately from the frame.
Figure 1B:
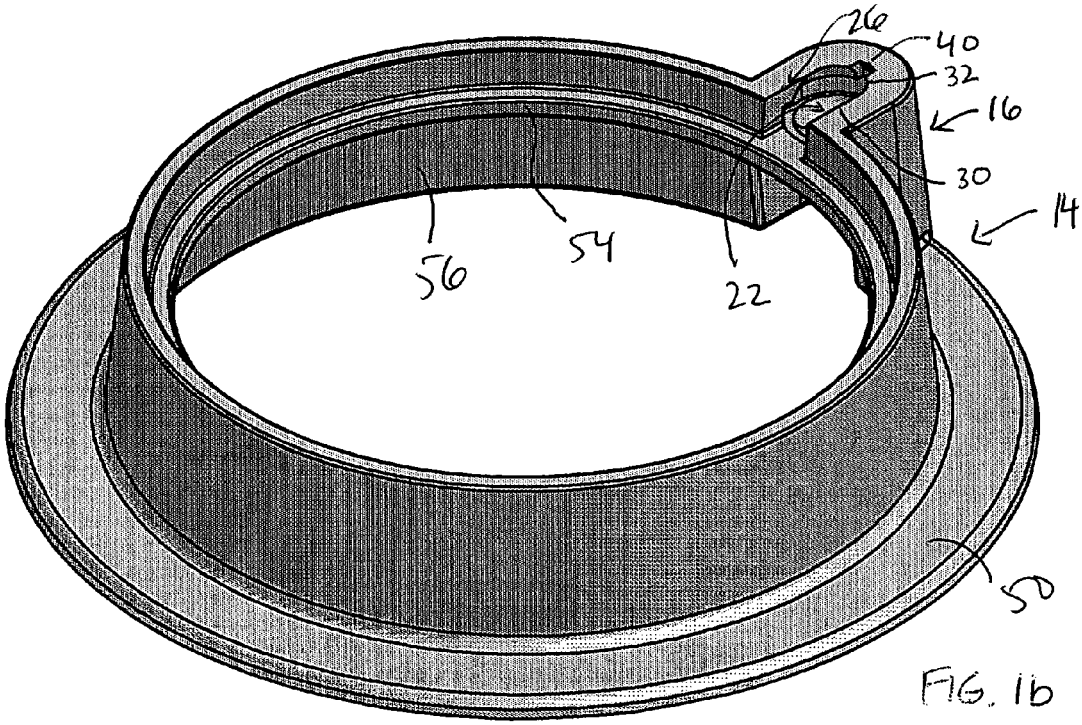
FIG. 1*b* is a perspective view of the manhole frame of FIG. 1, the frame shown separately from the cover.
Figure 5:
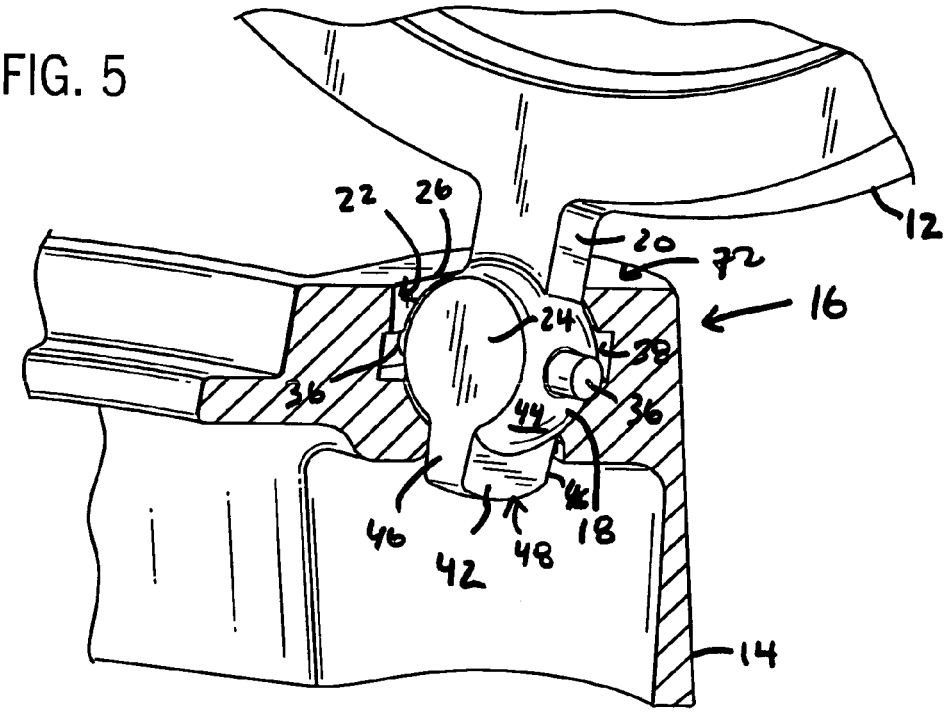
FIG. 5 is a partial cross-sectional view showing how a ball extending from the manhole cover fits within the socket shown in FIG. 4.

Referring FIGS. 1–1*b*, the present invention comprises a relatively simple hinge, cover and frame assembly 10. As can be seen, a cover 12 is connected to a frame 14 by a hinge subassembly or "joint" 16, such that cover 12 is seated in frame 14 when the cover 12 is in a closed position. As shown in FIG. 5, joint 16 is generally constructed in a ball and socket arrangement. Depending upon the particular type of cover and frame, and the degree of security necessary in the connection of the cover to the frame, different embodiments of joint 16 may be employed. Preferably, joint 16 is constructed so as to permit removal of a cover 12 from a frame 14 without tools. As will be described more fully herein, such removal may be accomplished by merely opening the cover 12 to its open position, twisting it 90°, and lifting it out. Each action is performed separately and can be done manually or with a lifting device, if desired.

Figure 4:
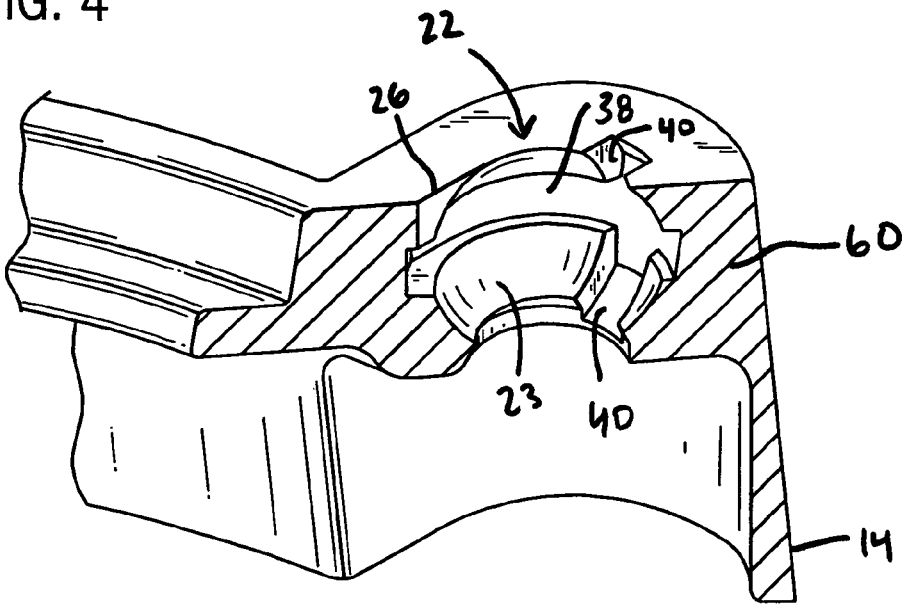
FIG. 4 is a partial cross-sectional view of the socket located in the manhole frame of FIG. 2, taken at line 4—4.

Referring to FIGS. 1*a* and 5, joint 16 has a first piece that includes a ball-shaped head 18 that is preferably connected to another structure such as cover 12. Generally, the ball-shaped head 18 will be connected to cover 12 (or other cover as described herein) via a neck portion 20 or the like. As seen in FIGS. 1*b* and 4, head 18 fits into a socket 22 that is generally defined by a wall or surface 23 shaped to conform around the head 18. Other features may be added to joint 16 to enhance its functionality.

Figure 2:
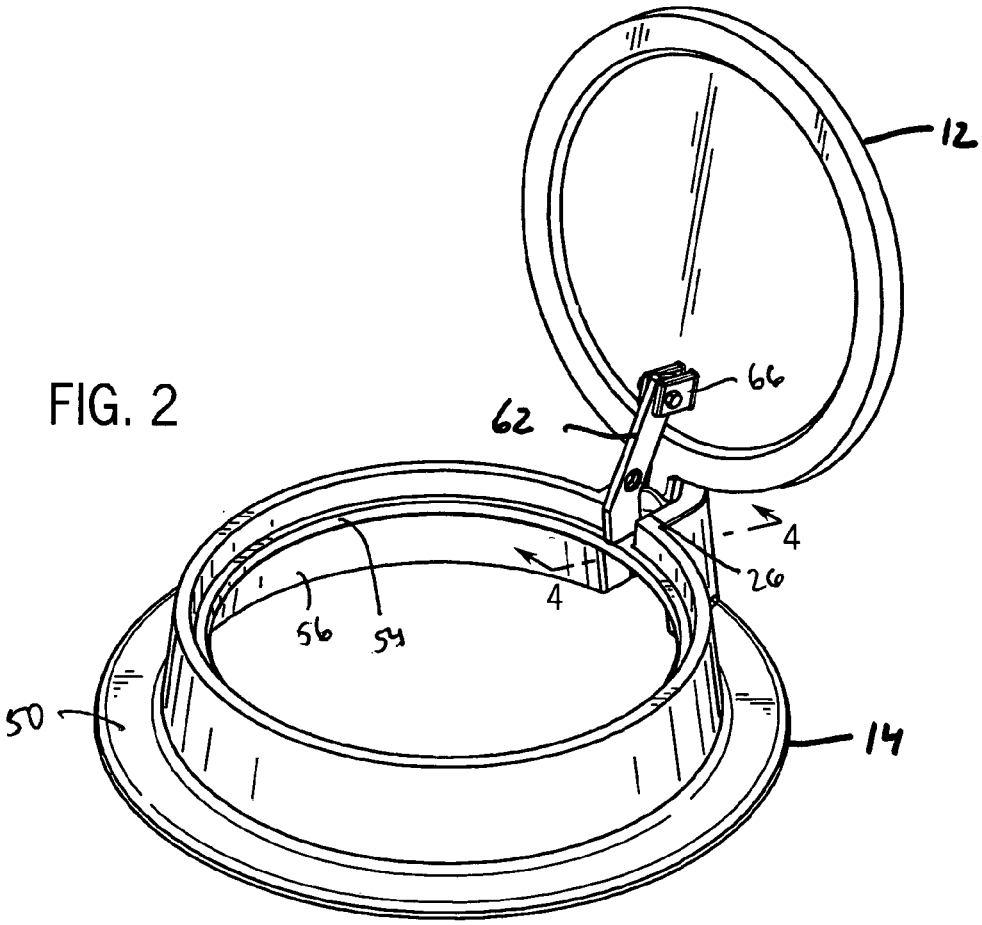
FIG. 2 is the manhole frame and cover of FIG. 1, with the cover locked in an open position.
Figure 6:
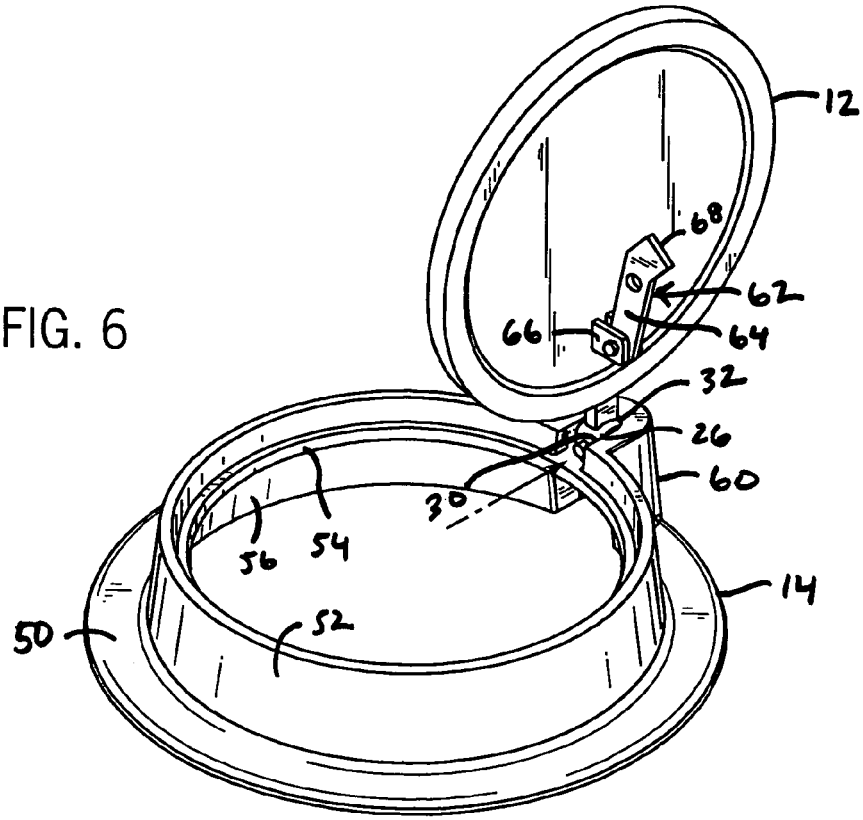
FIG. 6 is a perspective view of the manhole cover and frame of FIG. 2, with the cover twisted 90 degrees.

One such feature, present in one preferred embodiment of the invention, is the modification of head 18 in a shape that is not a perfect sphere. Instead, the head 18 has a pair of parallel, flat, planar faces 24 positioned in symmetric, spaced apart relation to one another. In other embodiments of the present invention, the faces 24 may have concave and/or embossed surfaces. In these embodiments, a collar 26 is positioned above socket 22 and is constructed to correspond to the faces 24. As shown in FIG. 1, where the head is constructed with the pair of flat faces 24, the collar is 26 preferably defined by a pair of straight portions 30 connected by an arc-shaped portion 32. The collar 26 has an open end located opposite arc shaped portion 32 to accommodate neck portion 20 when the cover 12 is in a closed position. Collar straight portions 30 are parallel and spaced apart at a distance in excess of the distance between the two flat faces 24. When head 18 is oriented so that faces 24 are substantially parallel with the inside edges of straight portions 30, head 18 fits between the straight portions 30 so that the head 18 can be inserted into socket 22. As can be seen in FIG. 6, when head 18 is fit between straight portions 30, cover 12 is sideways such that it cannot be lowered so as to achieve a closed position on frame 14. As seen in FIG. 2, when cover 12 is rotated through 90° so that the cover is in its normal open position, head 18 is also rotated such that flat faces 24 are perpendicular to straight portions 30. In this position, cover 12 cannot be removed from frame 14 because collar 26 restrains the head 18. Removal is not possible since the width of the head 18 in this position is wider than the space between the two collar straight portions 30. Thus, faces 24 and collar 26 operate to prevent the accidental release of head 18 from socket 22.

A second feature that may be incorporated in joint 16 is one or more bosses. See FIG. 5. In a preferred embodiment of the invention, a pair of cylindrical bosses 36 are positioned symmetrically on a common rotational axis that is centrally located between faces 24. When present, the bosses 36 fit into a groove 38 that runs horizontally below the top of the collar 26. Referring to FIG. 4, groove 38 bisects socket 22, and has a depth and height so that it can slidingly accommodate bosses 36. Thus, the cooperation between the bosses 36 and the groove 38 provide further resistance to the separation of the cover 12 from the frame 14 when the cover 12 is in its operational or deployed position. In order to permit the removal of cover 12 from the frame 14, a vertical slot 40 that is centrally located on the collar arc 32 is provided. When the cover 12 is rotated 90° to its removal position, one of the bosses 36 will fit to the slot 40, such that the head 18 can be extracted from the collar 26. When head 18 is inserted (or re-inserted) into the socket 22, a boss 36 slides through slot 40 until it reaches groove 38. At that point, head 18 can be twisted about the neck 20 axis so that bosses 36 slide within groove 38. It should be noted that slot 40 can terminate at groove 38, or extend below it. The slot's termination depends on the desired degree of lateral movement when the cover 12 is in its removal (or re-insertion) position or on the use of certain other features, as described below. Together, bosses 36 and groove 38 serve to restrict the movement of neck 20 (and any structure attached thereto). Within these restrictions, neck 20 may be twisted 360 degrees when oriented in a substantially vertical position, and neck 20 may rotate about bosses 36 when the bosses 36 are perpendicular to edges 30.

A third feature that may be incorporated into joint 16 is a guiding fin 42. Referring to FIG. 5, in accordance with another preferred embodiment of the present invention, fin 42 is a member that extends from the surface 44 of the head 18 directly opposite neck 20. The purpose of fin 42 is to restrict the movement of the cover 12 when moving from a generally vertical (open) position (see FIG. 3), to a horizontal (closed) position (see FIG. 1), through a single plane of rotation. Without the fin 42, the cover 12 could rotate during opening. Given the size and weight of the typical lid or grate used to cover manholes and the like, excessive rotation of the lid during opening could be dangerous and/or damaging. Preferably, the width of fin 42 matches the width of head 18 between the two faces 24 such that the two ends 46 of the fin 42 are flush with each of the faces 24. Also preferably, the shape of fin 42 follows the overall spherical shape of head 18 such that the back edge 48 of the fin has an arcuate shape. The back edge 48 of fin 42 is dimensioned to fit in the portion of vertical slot 40 which is extended below groove 38. In this embodiment, when the cover 12 is raised or lowered, the fin 42 moves within slot 40.

Most preferably, the assembly shown in FIGS. 1–6 includes the three features described above, namely fin 42, bosses 36, faces 24 and their corresponding slots and grooves. The frame 14 and cover 12 of assembly 10 need not be round or solid. Frame 14 and cover 12 may be rectangular (such as a hatch), slotted (such as a grate) or any other shape that fits the particular application for which a hinged cover is appropriate. In the preferred embodiment of assembly 10, frame 14 has an external annular flange 50 from which rises a substantially cylindrical wall 52. It should be noted that external annular flange 50 can be located anywhere on wall 52, including around the top of the wall 52, depending upon the application for which the assembly is intended. An inner flange 54 extends from the inner surface 56 of wall 52. Flange 54 provides a surface on which cover 12 rests when cover 12 is in a closed position.

In the preferred embodiment of assembly 10, joint 16 fits substantially within a housing station 60 that extends outwardly from wall 52. Socket 22 is formed and resides within the housing station 60 such that its receipt of head 18 maintains the cover 12 in a substantially horizontal position as it rests, in its closed position, on inner flange 54.

Figure 1C:
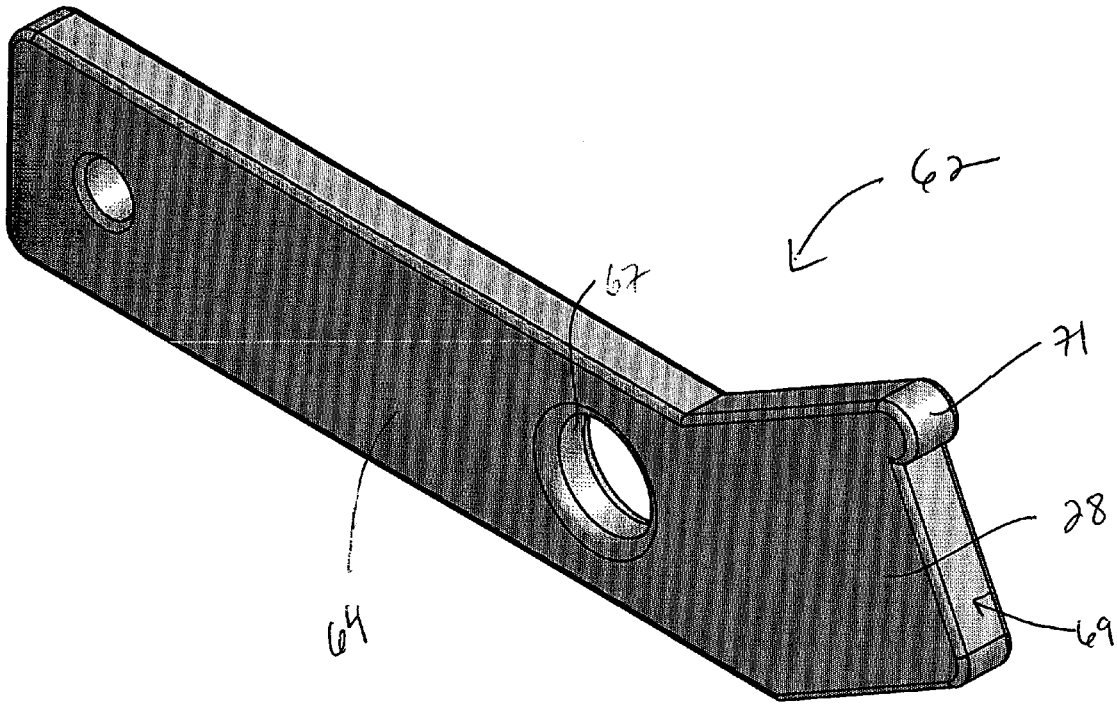
FIG. 1*c* is a perspective view of the latch shown in FIG. 1.
Figure 3:
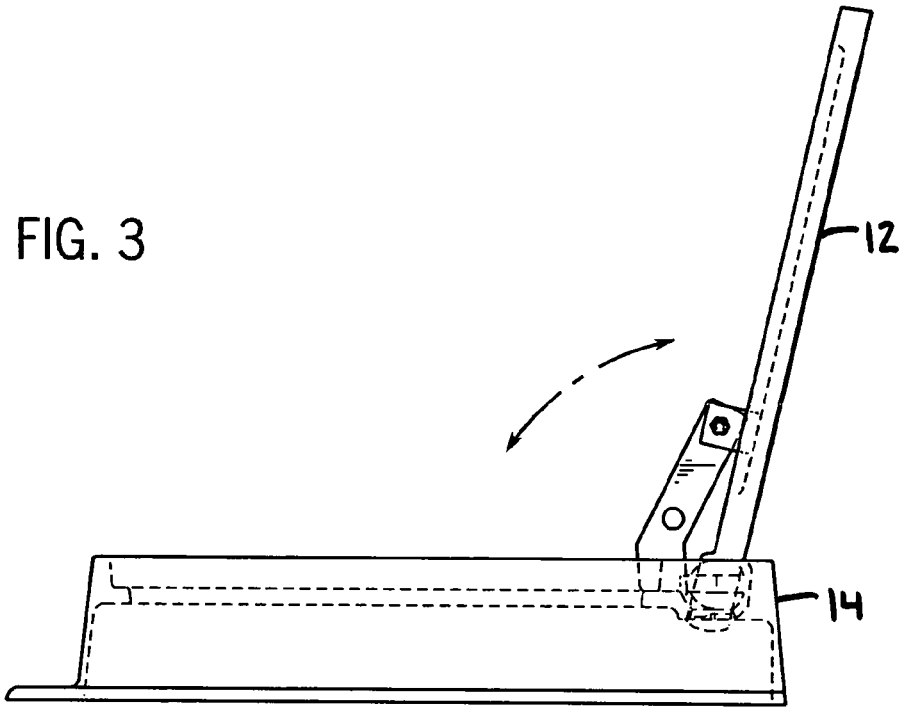
FIG. 3 a side elevational view of the manhole frame and cover of FIG. 2.

In another preferred embodiment of assembly 10, a cover latch 62 is included. The purpose of latch 62 is to selectively lock cover 12 in an open position. Latch 62 operates in such a way that the operator need not substantially lift the cover 12 to a more open position in order to close it. As best seen in FIG. 1*c*, latch 62 may be made from a metal bar having a main body 64. Referring to FIGS. 2 and 3, the proximal end of body 64 is pivotably fastened to cover 12 with a hinge assembly 66. The body 64 has a distal end 68 that selectively contacts the flange 54 when cover 12 is fully open. Preferably, distal end 68 has a bottom surface 69 that is configured to rest squarely on flange 54. This can be accomplished by angling the lower portion of body 64 resulting in a bottom surface that is at about 900 to the angled lower body or by angling the bottom surface itself at an appropriate obtuse angle relative to the body 64. Optionally, a boss 71 may be located on surface 69 adjacent the outermost edge of body 64. Boss 71 overhangs the frame flange 54. In addition, latch 62 may have an aperture 67 that extends through body 64. To close cover 12, aperture 67 may be hooked by a device that pulls the latch away from flange 54.

When cover 12 is in a closed position as shown in FIG. 1, and the assembly 10 is intended for use as a manhole cover in a street or other thoroughfare, it is preferred to have the top surface 70 of cover 12, the ball-head face 24, and the top surface 72 of housing station 60 in substantially flush relation. This makes travel over the manhole assembly much smoother than if these components were not flush. Of course, it is common practice to emboss any top surface of a construction casting such as manhole assembly 10 to denote source of manufacturer, denote location of manhole, or to provide aesthetic value and/or a safety feature.

In operation, assembly 10 can be easily assembled and disassembled. After frame 14 is placed into a roadway or other structure, cover 12 is oriented in a position approximately 90° from its normal open position as shown in FIG. 6. Head 18 is then aligned between straight portions 30 and inserted into socket 22. Once in place, the cover 12 is rotated approximately 90° to its normal open position. In the open position, if present, latch 62 can be used to maintain the cover 12 in place. The cover 12 is closed by disengaging latch 62 and seating cover 12 within the frame 14 on inner flange 54. To remove cover 12, the process is reversed.

Figure 7:
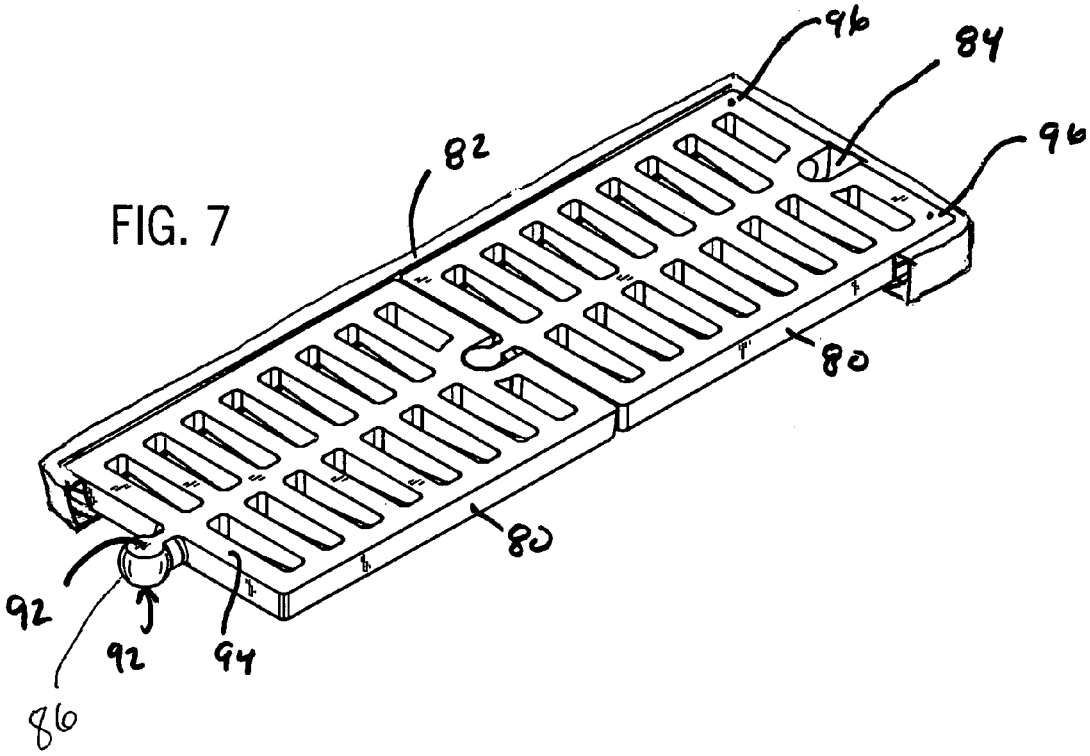
FIG. 7 is a perspective view of a pair of grate covers with the ball and socket joint of the present invention, the covers joined in series and the frame partially cut away.
Figure 10:
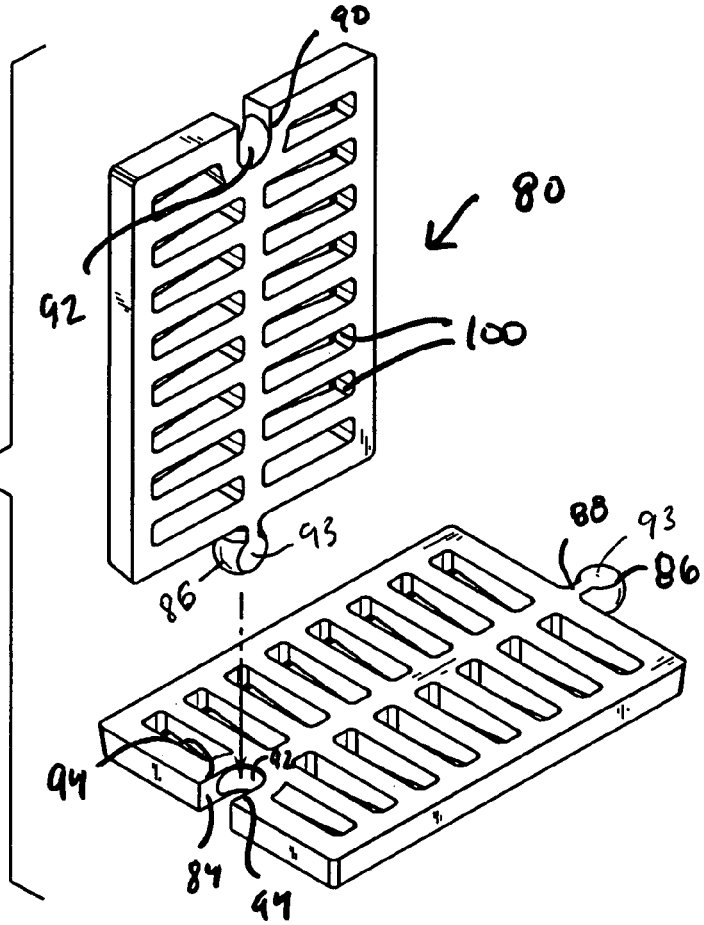
FIG. 10 is a perspective view of the cover of FIG. 8 being separated from another cover.

Referring to FIG. 7, in another embodiment of the present invention, a ball and socket joint 16 may be used in connection with a series of covers in the form of grates covering trench drain or the like. The grates 80 used to cover an elongated drain or opening are aligned in series and seated into a frame 82. Generally, each grate 80 connects end-to-end. As seen in FIG. 10, each grate 80 has a socket 84 in a first end and a ball head 86 at the opposite end that is connected to the grate 80 a via a neck portion 88.

Figure 8:
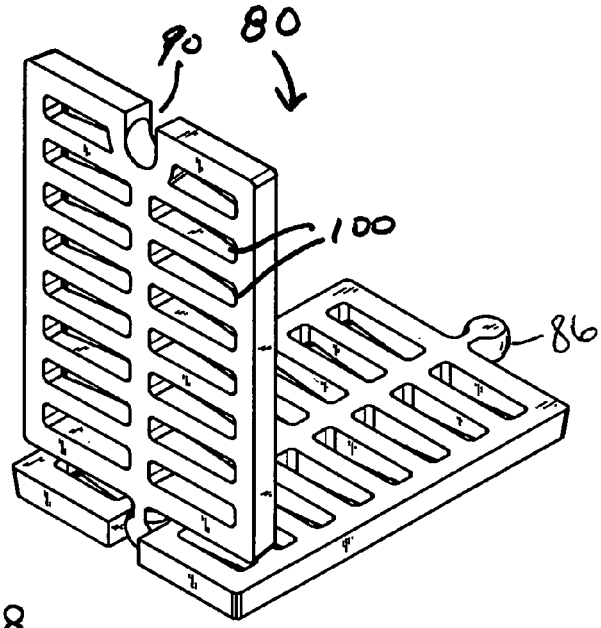
FIG. 8 is a perspective view of the grate covers of FIG. 8 showing a cover in a raised position.

Specifically, grate 80 may be an elongated rectangular shape as shown. Preferably, a socket 84 is located centrally at one end of each grate 80. The socket does not have to be centered, but the central location of socket 84 makes assembly easier. As seen in FIG. 8, socket 84 is defined, at least in part, by a U-shaped notch 90. Preferably U-shaped notch 90 includes a depression 92 that it conforms to the mostly spherical shape of ball head 86. Located on the opposite end of grate 80 is head 86. Like socket 84, head 86 is preferably aligned with the longitudinal axis of grate 80. As with prior embodiments, head 86 has a pair of opposite faces 93. Faces 93 preferably lie in the same plane as grate surface 94 so that pedestrians and vehicles will experience a relatively smooth surface. However, as in other embodiments, faces 93 may be embossed or the like.

The frame 82 is generally an elongated rectangular frame into which a series of grates 80 may be fitted. The last grate 80 to be placed in the series may be bolted to frame 82, such as shown in FIG. 7 at corners 96. Further, on the last grate 80, the socket 84 may be omitted if desired. The first grate 80 of a series may also be bolted to frame 82 at its two outermost corners. Alternatively, the frame may have a head 86 or socket 84 located at one end so that the first grate 80 of a series may be connected to the frame 82 by the joint of the present invention rather than a pair of bolts. In addition, a pair of centrally located grates may be bolted down on abutting edges rather than be joined by a joint or the present invention.

Figure 9:
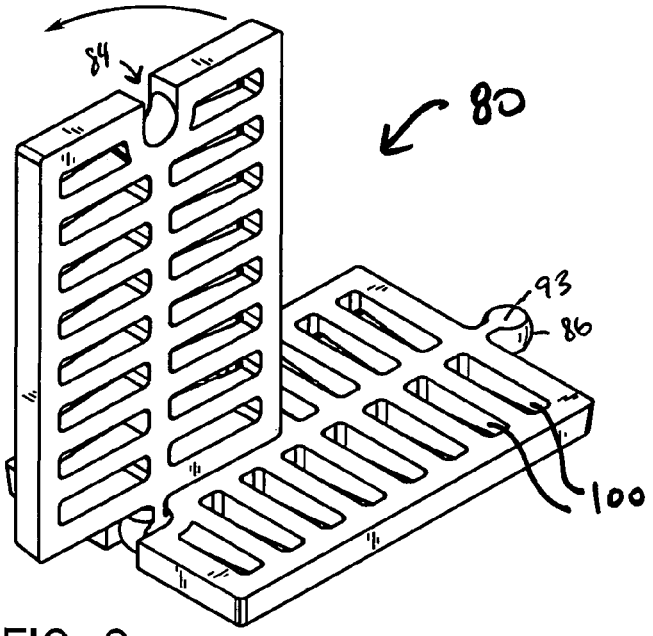
FIG. 9 is a perspective view of the grate covers of FIG. 9, showing the raised cover of FIG. 8 turned so that it may be detached from another cover.

In use, a first grate 80 is fit into frame 82. Consecutive grates 80 may be linked to the first until the frame is completely covered by grates 80. Preferably, the first and last grate 80 are bolted to frame 82 at their outermost corners. Removal of the grates 80 from frame 82 is demonstrated in FIGS. 8–10. In FIG. 8, a grate 80 is lifted from a horizontal (closed) position to a vertical upright (open) position. In FIG. 9, the upright grate 80 is twisted 90 degrees. In FIG. 10, the upright grate 80 can be removed by pulling it straight upward. This is repeated until the desired number of grates have been removed. As in the prior embodiment, the head 86 cannot be removed from frame 82 until the head faces 93 are parallel to the opposite edges 94 of socket 84.

Figure 11:
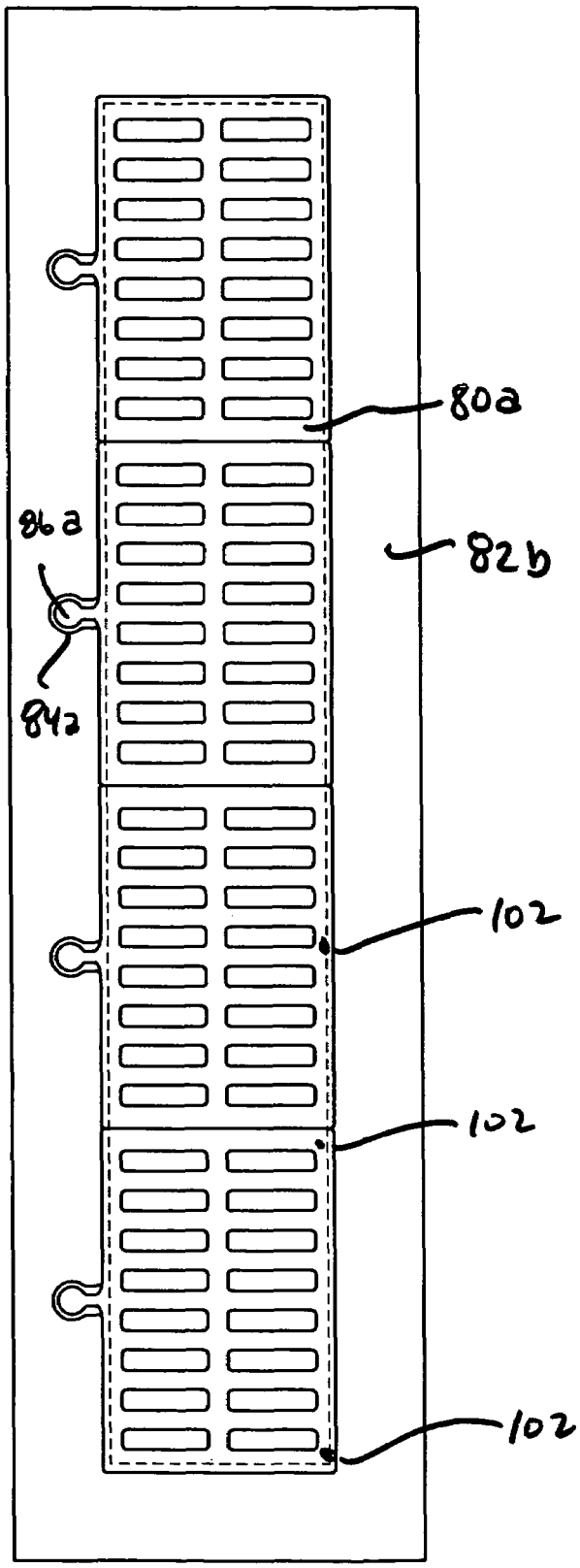
FIG. 11 is a perspective view of a series of grate covers using another embodiment of the invention, wherein each grate cover is connected to a frame.

In yet another embodiment of the present invention, the configuration of sockets and heads are identical to sockets 84 and beads 86 in the previous embodiment. However, in this embodiment, as show in FIG. 11, the location of the sockets and heads is different. Rather than connecting the grates 80 in series, each grate 80*a* is independently connected to frame 82*b*. Preferably, a socket 84*a* is located in frame 82*a*, and a corresponding head 86*a* is located on each grate 80a. Any grate 80*a* may be independently inserted and removed from frame 82*a* in a manner similar to that of the previous two embodiments. The grate may also be fastened to frame 82*a* so that it cannot be accidentally removed. For example, the side of grate 80*a* located opposite of head 86*a* may be fastened with a bolt or bolts 102.

The grates 80, 80*a* and 80*b* are shown in FIGS. 7–11 with a series of drainage outlets 100. However, such grates could have a solid surface or differently configured outlets 100. In addition, there are only two or four grates 80 shown in FIGS. 7–11. Any number of grates may be lined up in series.

While the invention has been described with reference to preferred embodiments, those skilled in the art will appreciate that certain substitutions, alterations, and omissions may be made without departing from the spirit of the invention. Accordingly, the foregoing description is meant to be exemplary only and should not limit the scope of the invention set forth in the following claims.

What is claimed is:

1. A manhole or hatch cover assembly comprising:

a lid having a top surface, a bottom surface and a perimeter, with a neck radially extending from the perimeter;

a substantially ball-shaped head attached to the neck, wherein the head has a first planar face opposite to and parallel with a second planar face;

a frame having a socket having a first opening located thereon that receives the ball-shaped head;

wherein the lid may be moved from a horizontal to a substantially vertical position, rotated and lifted so that it can be separated from the frame;

wherein the socket is defined by a wall adapted to substantially conform around a portion of a sphere;

wherein the first opening of the socket is defined by a collar having two opposite and parallel edges;

wherein the socket further includes a groove that horizontally bisects the socket wall, and wherein the collar has a slot located between the two opposite and parallel edges.

2. The assembly of claim 1 wherein the socket further includes a fin slot located in the socket wall, and the socket has a second opening located opposite the first opening.

* * * * *